US005474018A

United States Patent [19]

Lopez

[11] Patent Number: 5,474,018

[45] Date of Patent: Dec. 12, 1995

[54] REFRIGERANT STORAGE TANK STATUS INDICATOR

[76] Inventor: Jesus M. Lopez, P.O. Box 589, Tacoma, Wash. 98401

[21] Appl. No.: 193,559

[22] Filed: Feb. 8, 1994

[51] Int. Cl.[6] ..... G09F 9/00; G09F 9/40

[52] U.S. Cl. ..... 116/311; 116/318; 40/495

[58] Field of Search ..... 116/306, 309, 116/311, 312, 315, 316, 318, DIG. 1; 40/495, 501

[56] References Cited

U.S. PATENT DOCUMENTS

| | | | |
|---|---|---|---|
| Re. 30,637 | 6/1981 | King et al. . | |
| 989,835 | 4/1911 | Cole | 116/311 |
| 1,183,818 | 5/1916 | Hunnicutt | 40/495 |
| 1,207,448 | 12/1916 | Venable . | |
| 1,410,414 | 3/1922 | Sheets | 40/495 |
| 1,600,719 | 9/1926 | Davis | 40/495 |
| 2,098,394 | 11/1937 | Lane . | |
| 2,537,598 | 1/1951 | Mason | 116/309 |
| 3,180,310 | 4/1965 | Giebel . | |
| 3,249,085 | 5/1966 | St. Jean . | |
| 3,347,204 | 10/1967 | Beall | 116/312 |
| 3,455,273 | 7/1969 | Willingham, Jr. | 116/312 |
| 3,714,399 | 1/1973 | Cataland . | |
| 3,903,837 | 9/1975 | Barton et al. . | |
| 4,212,261 | 7/1980 | Gaetano | 116/312 |
| 4,886,010 | 12/1989 | Stutzman . | |
| 4,958,454 | 9/1990 | Chan et al. | 116/312 |
| 5,129,352 | 7/1992 | Roberts . | |

*Primary Examiner*—William A. Cuchlinski, Jr.
*Assistant Examiner*—Andrew Hirshfeld
*Attorney, Agent, or Firm*—Brian J. Coyne

[57] ABSTRACT

A device for indicating the status of a refrigerant storage tank and its contents. Three indicia bearing disks are separately mounted for rotation to the indicator. Each disk is divided into a plurality of annular sectors such that partial rotations of each disk expose successive sectors to view through windows in the display panel. A first disk bears indicia to display the type of refrigerant in the tank. A second disk bears indicia to display the recycle status of the refrigerant in the tank. A third disk bears indicia to display the intended disposition of the contents of the tank. A shaft is inserted through a central portion of each of the disks. Each shaft extends into apertures on the display panel and the backing plate located on the axes of rotation of the disks. A notch is provided on the periphery of each disk at the juncture of adjacent sectors. For each disk, a resilient catch partially embedded in the back plate has a free end that extends into a notch on a disk when a sector is wholly revealed in a window, thereby providing a detent for each sector of each disk.

2 Claims, 6 Drawing Sheets

REFRIGERANT STORAGE TANK STATUS INDICATOR

BACKGROUND OF THE INVENTION

1. Field of the Invention

The present invention relates generally to the field of contents indicators for containers, and more specifically to an indicator that designates the status of the contents of refrigerant storage tanks.

2. Description of the Prior Art

Refrigerants, such as R502, R12, and R22, are commonly stored under pressure in storage tanks. Persons responsible for maintaining such tanks need to communicate among themselves as to the status of the contents of the tanks as well as the status of the tanks themselves. The status of the tank can include several possibilities. There may be one of several different kinds of refrigerant in the tanks. The stored refrigerants may have been recycled, reclaimed or recovered after use in an automobile air conditioner, commercial walk-in freezer, or other refrigeration system. A refrigerant storage tank may be under vacuum. After a tank has been emptied of refrigerant, nitrogen is introduced into the tank to prevent moisture condensation inside the tank. A storage tank may have a leaky or defective pressure valve that requires repair or replacement.

Prior to my invention, indication of the status of the contents of refrigerant storage tanks, and of the need for repair or replacement of storage tank valves, has been haphazard: one or more handwritten or typed messages would be attached to or written onto storage tanks relating information regarding the type and status of refrigerants and/or regarding defective valves.

Contents indicators for containers other than refrigerant storage tanks are known in the prior art. Barton et al., U.S. Pat. No. 3,903,837 (Sep. 9, 1975), disclosed a dial indicator device for attachment to a storage bin or box, in which various items are stored, having a base member containing a plurality of indicia on the outer face thereof for indicating the contents of the bin or box, and having a rotatable cover dial with a window within the face of the dial for selectively exposing the indicia to indicate the status of the item(s) within a particular box or bin. The indicia might indicate, for example, "order" or "on order," thereby assisting in inventory control of the stored items.

B. E. Giebel U.S. Pat. No. 3,180,310 (Apr. 27, 1965), disclosed the combination of a paperboard container and apparatus for indicating the contents of said container, wherein an outer end wall panel of the container had a generally triangular opening and an annular disk was rotatably mounted on an axle just below the opening. The annular disk was provided with a plurality of indicia visible through the opening of the outer end wall panel, each indicia occupying a sector and identifying a possible content of the container—e.g., bottles carrying various ingredients.

There remains a need for a device to indicate the status of refrigerant storage tanks whereby the nature, history and intended disposition of the contents of the tanks may be easily ascertained.

SUMMARY OF THE INVENTION

This invention provides a device for indicating the status of tanks that store refrigerants under pressure. In a preferred embodiment, the device indicates the type of refrigerant stored in a tank, whether the refrigerant in the tank has previously been recycled or recovered, whether the refrigerant is to be recycled or be recovered, whether the refrigerant has been emptied out and replaced with nitrogen, and whether the tank contains a defective valve.

The device comprises three spaced-apart disks rotatably mounted to a rear surface of a display panel. Annular sectors of each disk contain indicia that indicate tank status: a first disk indicates the type of refrigerant in the tank; a second disk indicates the recycle status of the refrigerant in the tank; and a third disk indicates the intended disposition of the refrigerant—that is, whether the refrigerant should be reclaimed, destroyed, or brought up to factory or facility specifications. Three annular sector-shaped windows are cut out of the display panel to provide windows for viewing the indicia on the annular sectors of each disk.

OBJECTS OF THE INVENTION

An object of the present invention is to provide a device for indicating the status of a refrigerant storage tank that can be easily and rapidly adjusted and read.

Another object of the invention is to provide an indicator for a refrigerant storage tank that simultaneously indicates the contents of the tank, the recycle status of refrigerant in the tank, and whether the refrigerant in the tank should be reclaimed, destroyed or brought up to factory or facility specifications.

Another object of the invention is to provide an indicator for a refrigerant storage tank that can indicate that the tank has a defective valve.

Other objects, advantages, and novel features will become apparent from the following detailed description of my invention when studied in conjunction with the accompanying drawings.

DETAILED DESCRIPTION OF THE ILLUSTRATED EMBODIMENT

Figure 1:
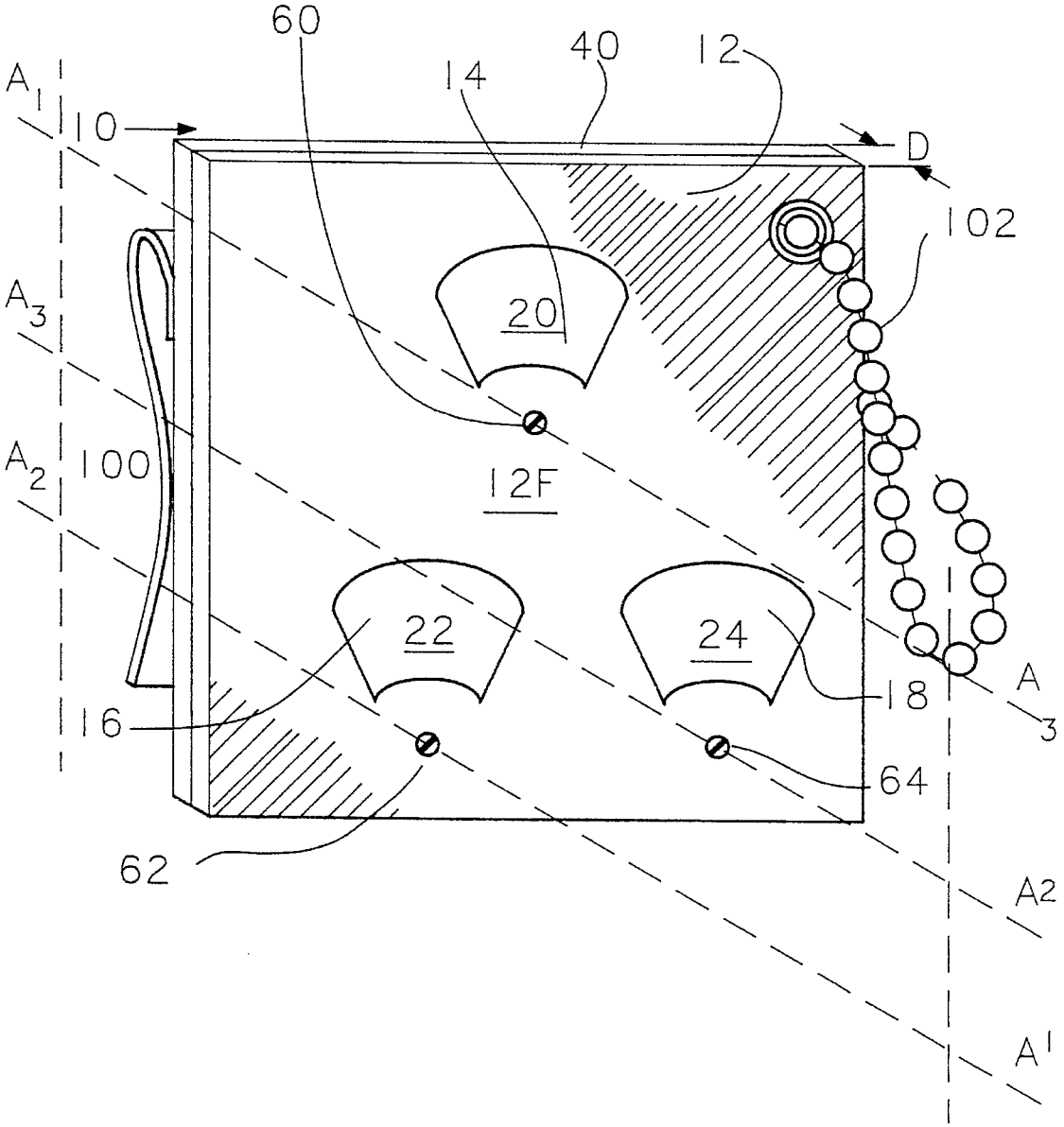
FIG. 1 is a frontal perspective view of the indicator of the present invention.

A refrigerant tank storage indicator 10 is illustrated in FIG. 1. In a preferred embodiment, the indicator 10 includes a flat display panel 12 having first, second and third annular sector-shaped windows 14, 16, 18, formed by circular sector cuts in the panel 12 about a first, second and third axis, A1, A2 and A3, respectively, and by radial cuts selected, preferably, to provide windows equal to one-fifth of an annulus. Although such windows 14, 16, 18 can literally be cut out of a panel 12, a preferred method for creating the windows is to cut or mold clear, transparent plastic (e.g., PLEXIGLASS) in the form of a rectangular panel 12, apply a temporary mask to each of the annular sector-shaped areas of the front surface 12F of the panel 12 chosen for the windows 14, 16, 18, sandblast the front surface 12F to make it non-transparent except for the chosen areas for said windows 12, 14, 16, and then remove the temporary mask.

A first indicia bearing disk 20 for indicating the contents of a refrigerant storage tank is mounted to the panel 12 for rotation about axis A1 and for viewing through window 14. A second indicia bearing disk 22 for indicating the recycle status of a refrigerant in a storage tank is mounted to the panel 12 for rotation about axis A2 and for viewing through window 16. A third indicia bearing disk 24 for indicating the intended disposition of a refrigerant in a storage tank is mounted to the panel 12 for rotation about axis A3 and for viewing through window 18.

Figure 2A:
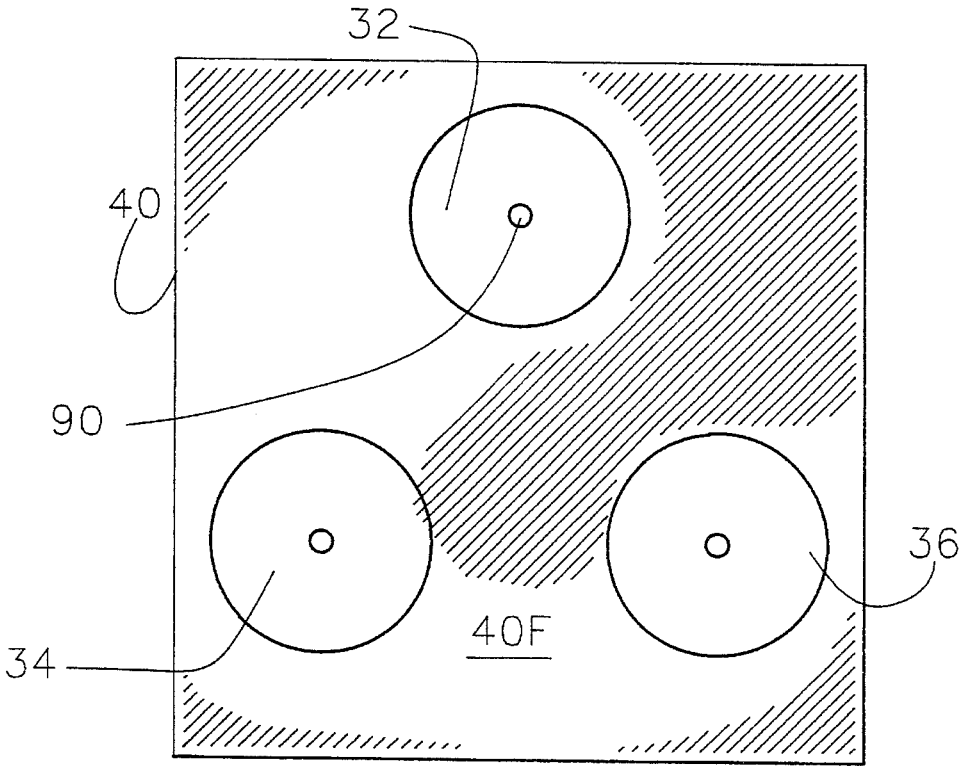
FIG. 2(*a*) is a front elevational plan view and FIG. 2(*b*) is a rear elevational view of the backing plate thereof with the visor-type clip and chain and eyelet loop removed.
Figure 2B:
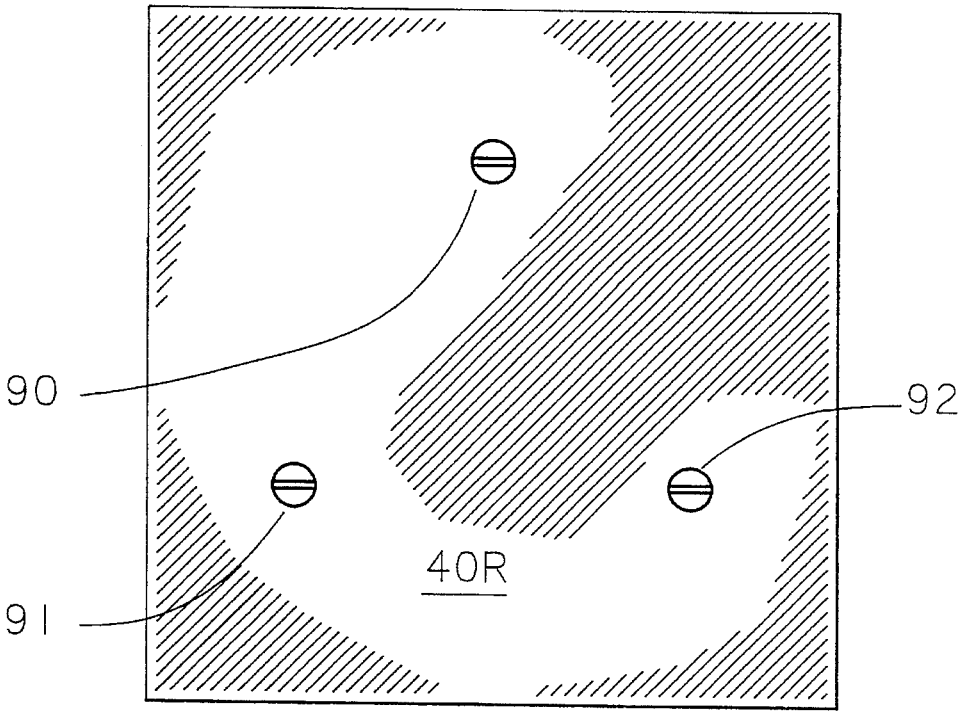
Figure 3:
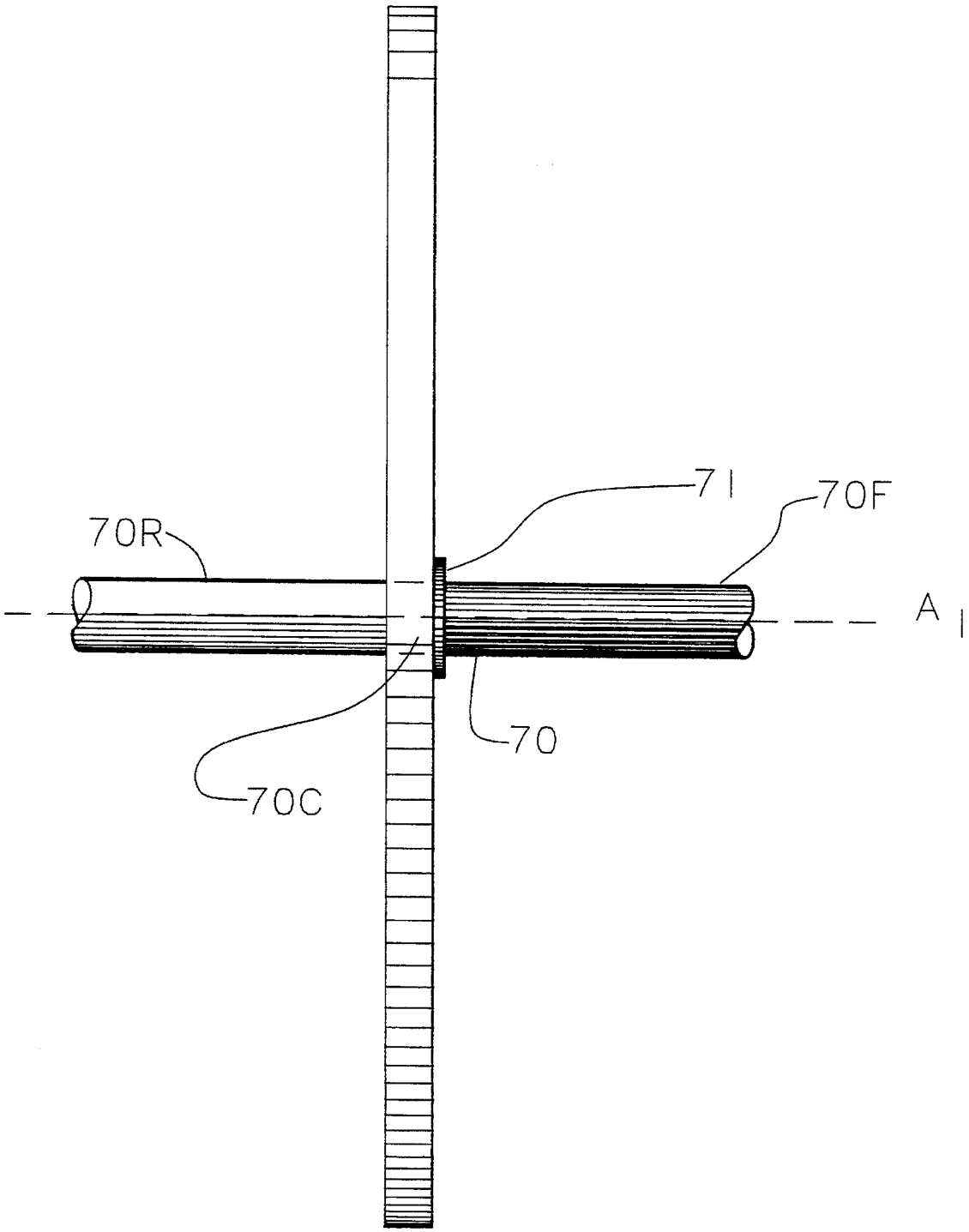
FIG. 3 is an enlarged side elevational view of a disk and mounting shaft.

To prevent rearward displacement of the disks 20, 22, 24, disposed adjacent to a rear surface of the panel 12 is a rectangular back plate 40 equal in length and breadth to the panel 12. As may be seen in FIG. 2(*a*), a forward surface 40F of the back plate 40 has a first, second and third circular recess 32, 34, 36, concentric with the first, second and third axis, A1, A2, and A3, respectively. The size of the first, second and third recess 32, 34, 36, is, preferably, just slightly larger than the size of the first, second and third disks, 20, 22, 24, respectively, so that the disks 20, 22, 24, will be received and closely encircled by the cylindrical walls W of the recesses 32, 34, 36, respectively. A front surface 40F of the back plate 40 is attached to a rear surface of the panel 12.

Figure 4:
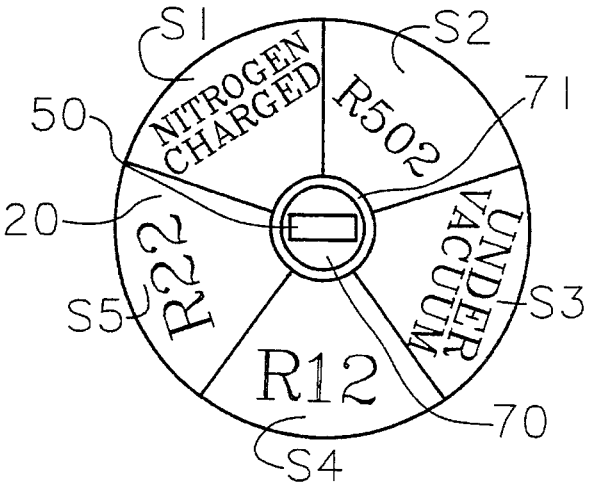
FIG. 4 is a front elevational view of a first indicia bearing disk for indicating the type of refrigerant in a tank.

Referring to FIG. 4, a first disk 20 for indicating the contents of a refrigerant storage tank is shown divided into five annular sectors, S1–S5, each sector bearing printed indicia. Preferably, each sector of the first disk 20 bears indicia chosen from one of 'NITROGEN CHARGED,' 'UNDER VACUUM,' 'R12,' 'R502,' or 'R22,' or is left blank.

Figure 5:
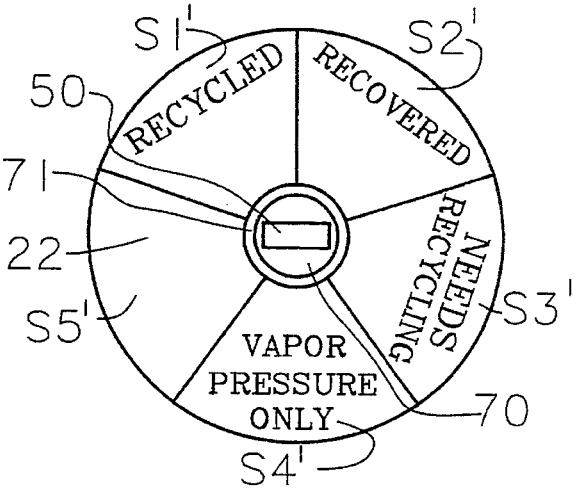
FIG. 5 is a front elevational view of a second indicia bearing disk for indicating the recycle status of refrigerant in a tank.

Referring to FIG. 5, a second disk 22 for indicating the recycle status of refrigerant in a storage tank is shown divided into five annular sectors, S1'–S5'; preferably each sector of the second disk 22 bears indicia chosen from one of 'RECYCLED,' 'RECOVERED,' 'NEEDS RECYCLING,' VAPOR PRESSURE ONLY,' or is left blank.

Figure 6:
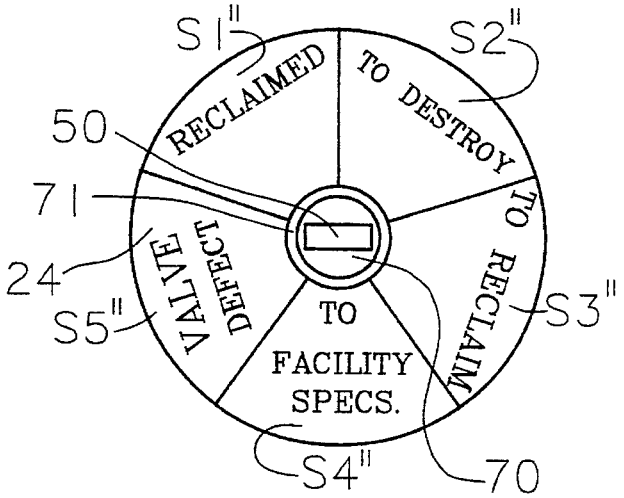
FIG. 6 is a front elevational view of a third indicia bearing disk for indicating the intended disposition of the refrigerant in a tank.

Referring to FIG. 6, a third disk 24 for indicating the intended disposition of the refrigerant in a storage tank is shown divided into five annular sectors, S1"–S5"; preferably, each sector of the third disk 24 bears indicia chosen from one of 'RECLAIMED,' 'TO DESTROY,' 'TO RECLAIM,' 'TO FACILITY SPECS.,' or is left blank.

As may be seen, for example, in FIGS. 4–6, each disk 20, 22, 24, has a shaft 70 inserted through its center to which it is rigidly attached for mounting to the indicator 12. Each shaft 70 has a front portion 70F, center portion 70C, and a rear portion 70R, such that the combined lengths of 70F, 70C and 70R just equals the depth D of the indicator 10; thus, the forward portions 70F and the rear portions 70R terminate flush with the front and rear surfaces of the indicator 12F, 40R. For rotatably mounting the disks 20, 22, 24 to the indicator 10, the panel 12 has apertures 60, 62, 64, and the back plate 40 has apertures 90, 91, 92, located on axes A1, A2, and A3, respectively, for receiving the respective front and rear shaft portions 70F, 70 R, of each of the disks 20, 22, 24. To reduce the possibility of chance or unauthorized rotations of the disks 20, 22, 24, which would cause the display of incorrect or undesired information, the disks 20, 22, 24 should be rotatable only by means of a screwdriver. Therefore, the front portion 70F of each shaft 70 includes a slot for receiving the tip of a screwdriver. Partial rotations of the disks 20, 22, 24 by a screwdriver cause selected indicia thereon to become visible in the respective windows 14, 16, 18.

Figure 7:
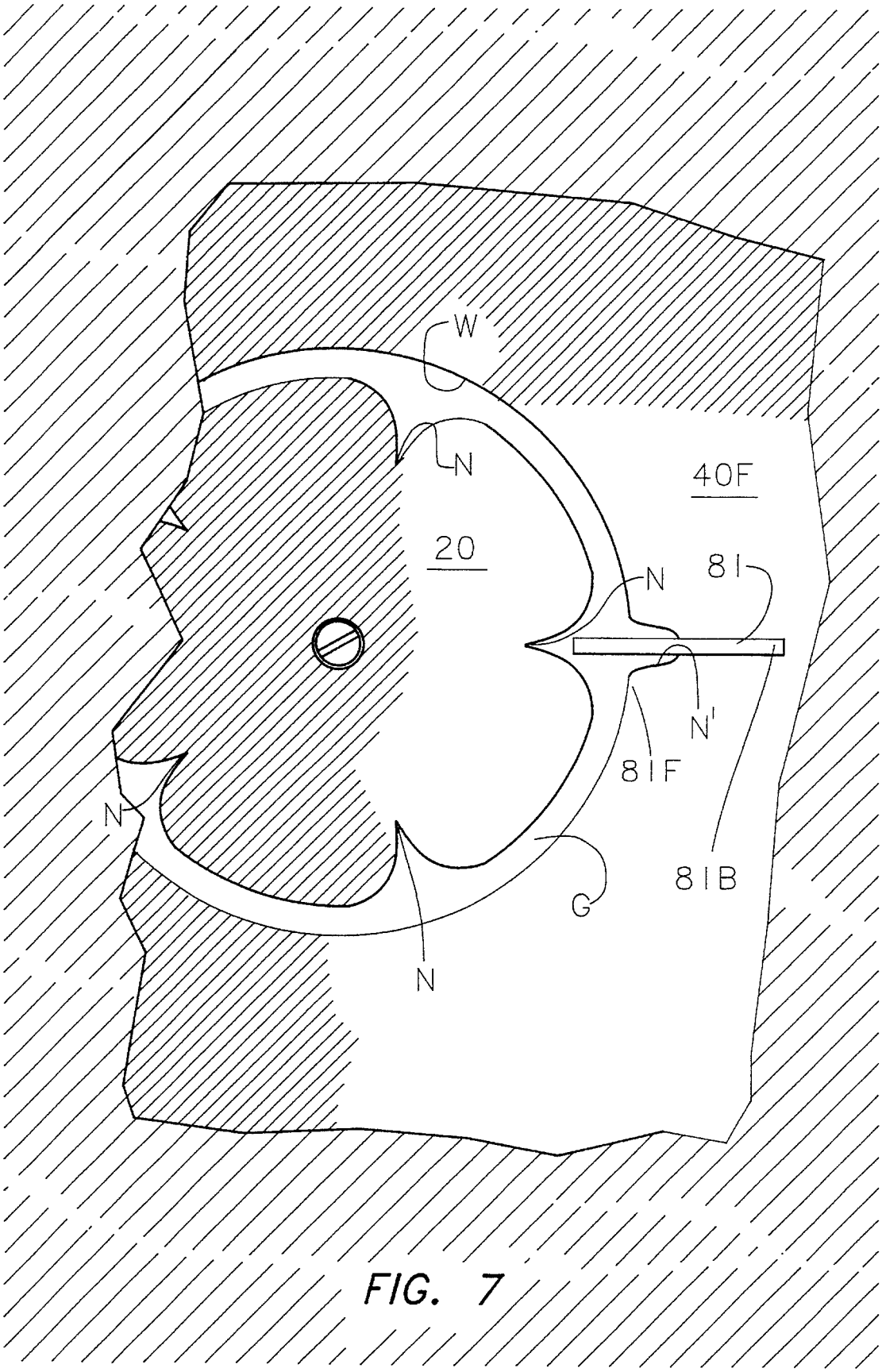
FIG. 7 is an enlarged partial front elevational view thereof with the front panel, removed, showing a notch in the periphery of a disk with a catch inserted therein.

Referring again to FIGS. 3–6, it may be seen that a ring 71 is circumposed around the forward portion 70F of each shaft 70 and disposed between a rear surface of the panel 12 and each disk 20, 22, 24, which provides a bearing surface for smooth rotation of the disks. The ring 71 can be a metal washer or can be a circular flange integral to, and formed from, a central portion of each plastic disk 20, 22, 24. It is also desirable to provide a detent for each annular sector of each disk 20, 22, 24, so that partial rotations of each disk will cause the sectors of the disk to snap into a sequence of viewing positions. For this purpose, a V-shaped notch N is preferably cut out of the periphery of each disk 20, 22, 24 at the juncture of adjacent sectors, as may best be seen in FIG. 7. For each of the disks, 20, 22, 24, a resilient detaining catch 81 is provided, preferably in the form of a thin band of resilient metal. Each catch 81 has a base end 81B embedded in a front surface 40F of the back plate 40 and an opposite, free end 81F extending across the gap G between the periphery of each disk 20, 22, 24 and the cylindrical walls W of the recesses 32, 34, 36. Each catch 81 is located such that the free end 81F of the catch 81 will intrude into a notch N if, and only if, a sector is wholly revealed in a window 14, 16, 18. In order to permit easy movement of the free end 81F of the catch 81 as each disk 20, 22, 24 is rotated, preferably a notch N' is cut into each wall W of the recesses 32, 34, 36 near the base end 81B of each catch 81.

Figure 8:
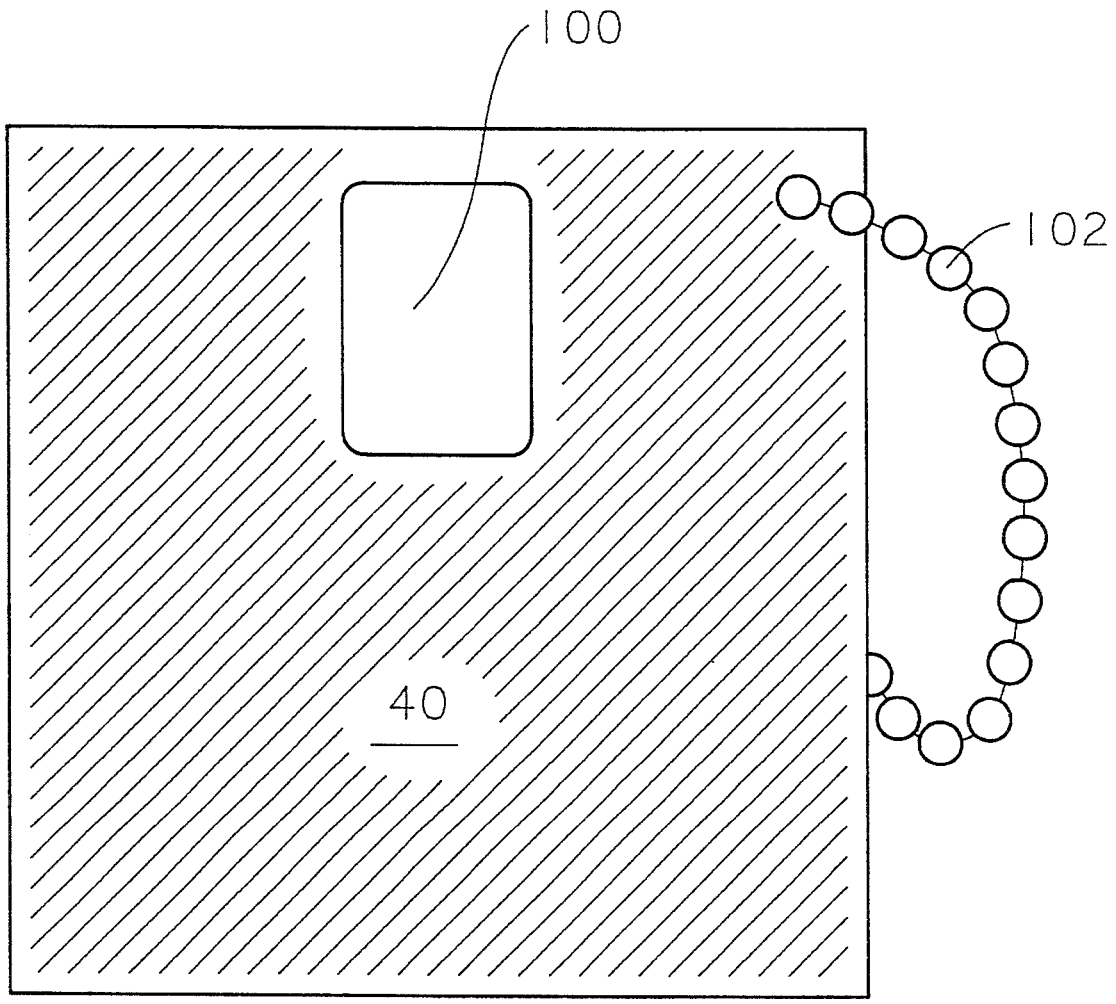
FIG. 8 is a rear elevational view of the indicator.

One preferred means for attaching the indicator to a storage tank is by a visor-type clip 100, as shown in FIGS. 1 and 8. Another means is by a chain and eyelet loop 102 attached to the indicator, as illustrated in FIG. 1, which loop can be placed around a valve stem of a storage tank, for instance.

The foregoing is merely illustrative of this invention. The specific indicia to be printed on the disks will depend upon the types of refrigerants and conditions most frequently encountered. The indicator could be any of several different shapes, including rectangular, circular, elliptical, etc. The panel 12, disks 20, 22, 24, back plate 40, and shafts 70 could be made from a variety of materials that are rigid and durable enough for the purpose, including suitable types of plastic, paperboard, and metal. Obviously, many modifications and variations of the present invention are possible in the light of the above teachings. It is therefore to be understood that within the scope of the appended claims the invention may be practiced otherwise than as specifically described.

I claim:

1. A refrigerant storage tank status indicator, comprising:

(a) a display panel having first, second, and third annular sector-shaped windows defined by circular sectors inscribed in the panel about a first, second and third axis, respectively;

(b) a first indicia bearing disk divided into annular sectors and notched peripherally at the junctures of adjacent sectors, for indicating contents of a refrigerant storage tank, at least one of the sectors thereof having indicia chosen from one of 'NITROGEN CHARGED', 'UNDER VACUUM', 'R502', 'R22', and 'R12';

(c) a second indicia bearing disk divided into annular sectors and notched peripherally at the junctures of adjacent sectors, for indicating the contents of the tank, at least one of the sectors thereof having indicia chosen from one of 'RECYCLED', 'RECOVERED', 'NEEDS RECYCLING', and 'VAPOR PRESSURE ONLY';

(d) a third indicia bearing disk divided into annular sectors and notched peripherally at the junctures of adjacent sectors, for indicating an intended disposition of refrigerant in the tank, at least one of the sectors thereof having indicia chosen from one of 'RECLAIMED', 'TO DESTROY', 'TO RECLAIM', and 'TO FAC. SPECS.';

(e) means for mounting the first, second, and third disks to a rear surface of the display panel for rotation about the first, second, and third axes, respectively, comprising:

(1) a back plate having substantially the same width and breadth as the display panel, which back plate is attached to the rear surface of the display panel;

(2) a first shaft affixed to and inserted through a central portion of the first disk, a second shaft affixed to and inserted through a central portion of the second disk, and a third shaft affixed to and inserted through a central portion of the third disk, (f) a first resilient catch for the first disk, the first catch having a fixed end partially embedded in the back plate adjacent to the first disk, and an opposite free end that intrudes into one of the peripheral notches of the first disk if, and only if, one of the sectors of the first disk appears wholly revealed within the first window; a second resilient catch for the second disk, the second catch having a fixed end partially embedded in the back plate adjacent to the second disk, and an opposite free end that intrudes into one of the peripheral notches of the second disk if, and only if, one of the sectors of the second disk appears wholly revealed within the second window; a third resilient catch for the third disk, the third catch having a fixed end partially embedded in the back plate adjacent to the third disk, and an opposite free end that intrudes into one of the peripheral notches of the third disk if, and only if, one of the sectors of the third disk appears wholly revealed within the third window; for each catch a recess is cut into a front surface of the back plate near the fixed end of each catch in order to promote easy movement of the free end of each catch during rotation of the disks, wherein the display panel is formed from a transparent plastic a front surface whereof has been made everywhere non-transparent by sand blasting except at the locations of the windows, each of the disks is disposed between the display panel and the back plate, the display panel and the back plate each have a first, second, and third aperture located on the first, second, and third axes, respectively, the back plate has a first, second and third recesses located on the first, second, and third axes, respectively, said first, second, and third recesses receiving and completely encircling the first, second, and third disks, respectively, the first shaft is inserted into the first apertures, the second shaft is inserted into the second apertures, and the third shaft is inserted into the third apertures.

2. The indicator of claim 1 in which at least one sector of one of the disks bears the indicia 'VALVE DEFECT' to denote the existence of a defective valve on the refrigerant storage tank.

* * * * *